US007503519B2

(12) United States Patent
Haven et al.

(10) Patent No.: US 7,503,519 B2
(45) Date of Patent: Mar. 17, 2009

(54) WINDER ROLL STARTING APPARATUS WITH PRESSURE DEVICE FOR THICK WEBS

(75) Inventors: Charles E. Haven, Kaukauna, WI (US); Jeffrey K. Klemens, Kaukauna, WI (US)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 12/119,153

(22) Filed: May 12, 2008

(65) Prior Publication Data

US 2008/0210806 A1 Sep. 4, 2008

Related U.S. Application Data

(62) Division of application No. 11/140,397, filed on May 27, 2005, now Pat. No. 7,458,539.

(51) Int. Cl.
*B65H 19/28* (2006.01)

(52) U.S. Cl. ..... 242/532; 242/532.1; 242/532.2; 242/532.3

(58) Field of Classification Search ..... 242/532, 242/532.1–532.3, 542
See application file for complete search history.

(56) References Cited

U.S. PATENT DOCUMENTS

| | | | |
|---|---|---|---|
| 2,732,772 | A | 1/1956 | Hornbostel |
| 3,539,125 | A | 11/1970 | Patriksson et al. |
| 3,908,924 | A | 9/1975 | Schulze |
| 4,125,659 | A | 11/1978 | Klowak et al. |
| 4,208,459 | A | 6/1980 | Becker et al. |
| 4,345,722 | A | 8/1982 | Kuhn |
| 4,370,193 | A | 1/1983 | Knauthe |
| 4,721,263 | A | 1/1988 | Miyazaki |
| 4,881,695 | A | 11/1989 | Beisswanger |
| 4,893,741 | A | 1/1990 | Heinzmann |
| 5,232,554 | A | 8/1993 | Kotitschke |
| 5,232,555 | A | 8/1993 | Daunais et al. |
| 6,338,451 | B1 | 1/2002 | Dörfel et al. |
| 6,581,868 | B1 | 6/2003 | Enwald et al. |
| 2002/0106178 | A1 | 8/2002 | Bumgarner et al. |

*Primary Examiner*—Sang Kim
(74) *Attorney, Agent, or Firm*—Stiennon & Stiennon

(57) ABSTRACT

A winder has a scraper mounted about the axis of a winder drum for circumferential movement. The scraper has a semi-cylindrical concave surface which extends in the cross machine direction, the concave surface meets a second surface to form a scraping edge. The scraping edge engages the winder drum, scraping a web from the surface of the winder drum and pressing the web into engagement with double-sided sticky tape on a winder core with the concave surface.

11 Claims, 1 Drawing Sheet

WINDER ROLL STARTING APPARATUS WITH PRESSURE DEVICE FOR THICK WEBS

CROSS REFERENCES TO RELATED APPLICATIONS

This is a divisional application of U.S. application Ser. No. 11/140,397, filed May 27, 2005, now U.S. Pat. No. 7,458,539, issued Dec. 2, 2008, the disclosure of which is incorporated herein reference.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to winders in general, and to apparatus for starting a new winding core in a winder in particular.

When paper, paperboard, or roll pulp is manufactured, it is initially wound into jumbo rolls at the end of a papermaking machine. The jumbo rolls are then processed through a slitter and winder which converts the jumbo roll into smaller rolls i.e., sets from which products are made, from newspapers to, in the case of roll pulp, diapers and sanitary napkins.

Roll pulp and products such as paperboard are relatively thick so that when wound onto a set roll, a roll of a selected diameter is rapidly formed. Once a set roll is formed, a new winding core must be placed in the winder, and a new tail or start formed by cutting the web must be attached to the new winding core. Roll pulp is a thick absorptive web which may be, for example, 1.2 mm thick. Roll pulp is used in such products as diapers and sanitary napkins. In such applications it is the present industry standard that no foreign material such as hot glue residuals find there way into the final product. For this reason, only double-sided sticky tape can be used to attach the web to a cardboard winding core. The tape stays with the cardboard winding core when the roll pulp is used and thus, unlike hot-melt glue, cannot find its way into the finished product.

The normal process of using a winder with roll pulp or board webs, which cannot be moved by an air blow, involves bringing the machine to a stop, slicing the web, placing double-sided sticky tape on a winding core and placing the core in the winder, and manually pressing the roll pulp web onto the double sided tape on the winding core, then winding a set and repeating the process. For thinner paper webs it is possible to automate the process becomes the web can be blown onto the winding core, or picked up by the double-sided sticky tape from the reeling drum. Neither of these processes work if the web is too stiff. With a thicker web it is necessary to start a new reel or set often, and when starting a new set it is necessary to press the thicker web onto the double-sided sticky tape by hand. These steps require significant labor and time, so that the winder may be operating less than half of the time.

What is needed is a way to increase productivity when rewinding thicker paper or fiber webs.

SUMMARY OF THE INVENTION

The winder of this invention has a scraper mounted about the axis of a winder drum for circumferential movement. The scraper has a body which has portions forming a semi-cylindrical concave surface which extends in the cross machine direction, the concave surface meets a second cross machine direction extending surface to form a scraping edge. The scraper pivots about the axis of the winder drum, with the scraper edge in engagement with the winder drum surface, and the concave surface facing in the direction of travel defined by the pivotal motion of the scraper about the axis of the winder drum. The concave surface of the scraper has a cylindrical radius such that the concave surface closely matches the surface of a winding core, so that when the scraper is moved about the winder drum axis the scraper edge comes between the winder drum and the web, pushing a web tail onto the concave surface of the scraper. Further motion of the scraper about the winder drum axis brings the scraper concave surface and the web tail into engagement with the winding core and presses the web tail against the winding core. Double-sided sticky tape on the winding core attaches the web to the winding core as the scraper concave surface presses the web tail against the winding core.

An alternative embodiment scraper has a flexible blade mounted in the cross machine direction which functions similar to a spatula, and which scrapes the pulp web off the surface of the winder drum and wipes the pulp web onto the double-sided sticky tape on the winding core.

It is a feature of the present invention to increase the productivity of a slitter winder by reducing the time required to change winding cores when heavier grades of paper, linerboard, and roll pulp are being processed.

It is another feature of the present invention to decrease the need for an operator to perform manual steps when rewinding heavier grades of paper, linerboard and roll pulp.

It is a yet further feature of the present invention to provide a system for positioning and moving a device to transfer and press a relatively heavy and stiff web onto a winding core.

Further objects, features and advantages of the invention will be apparent from the following detailed description when taken in conjunction with the accompanying drawings.

DESCRIPTION OF THE PREFERRED EMBODIMENTS

Figure 1:
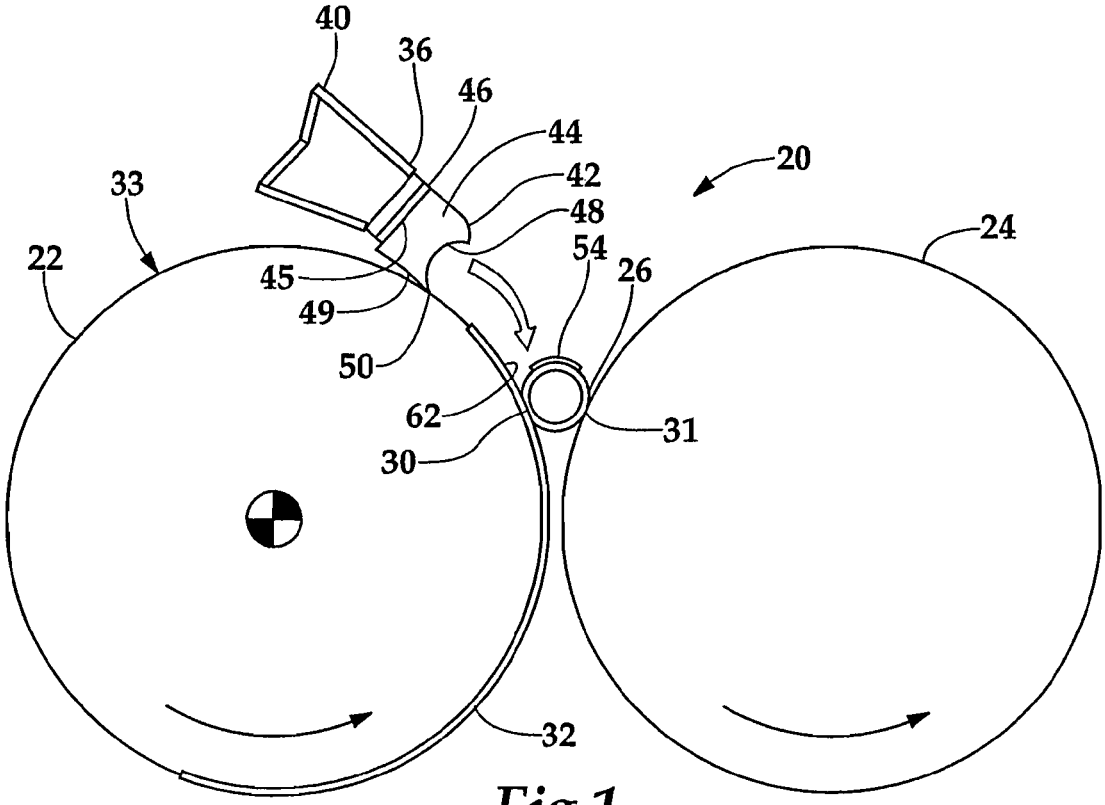
FIG. 1 is a schematic side elevational view of a winder of this invention, illustrating a scraper and pressing device engaged with a winder drum.
Figure 2:
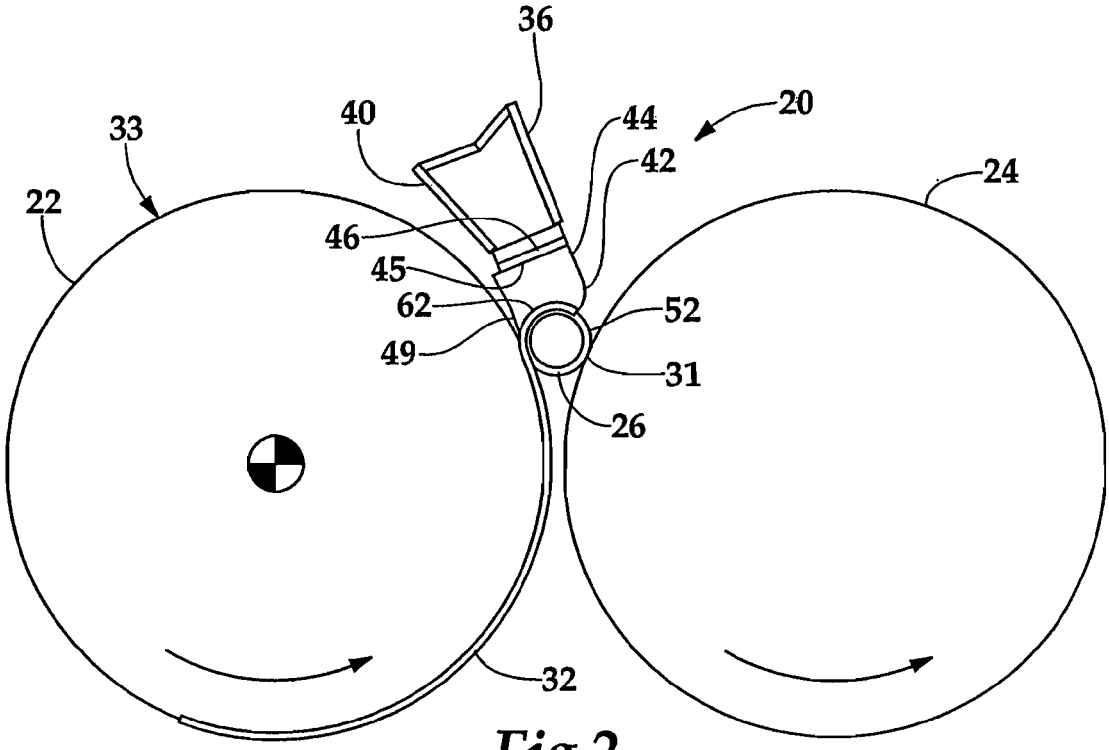
FIG. 2 is a schematic side elevational view of the winder of FIG. 1 illustrating the scraper and pressing device pressing a web against a winding core.

Referring more particularly to FIGS. 1-2, wherein like numbers refer to similar parts, a twin drum winder 20 is shown in FIGS. 1-2. As shown in FIG. 1, the winder 20 has a rear winder drum 22 and a front winder drum 24 in spaced parallel relation, on which a winding core 26 is positioned for the winding of a roll. A scraping and pressing device 36 is mounted with respect to the winder 20 to facilitate the attachment of a pulp web 32 to the core 26. After a completed roll set has been wound, the winder is stopped, the completed roll set removed, and, as shown in FIG. 1, a new winding core 26 is positioned between the rear winder drum 22 and the front winder drum 24 such that the core forms a first nip 30 with the rear winder drum 22 and a second nip 31 with the front winder drum 24. The pulp web 32 extends along the cylindrical surface 33 of the rear winder drum 22, and, when the winding core is positioned in the winder, the web 32 is held in the nip 30 between the winding core 26 and the rear winder drum 22. The scraping and pressing device 36 is mounted above the winder 20 and is arranged to engage and move along the cylindrical surface 33 of the rear winder drum 22 until the scraping and pressing device presses the pulp web 32 against the winding core as shown in FIG. 2. The scraping and pressing device 36 has a cross machine direction extending beam 40, to which a scraping structure 42 is attached.

The scraping structure 42 is comprised of a plurality of cross machine direction sections 44 e.g., one every 10 to 12 inches, of ultrahigh molecular weight (UHMW) plastic such as polyethylene, which are mounted to the scraping structure 42 by elastic pads 46. The sections 44 have portions 45 which engage the elastic pads 46, and portions forming a concave cross machine direction extending semi-cylindrical surface 48. The concave surface 48 meets a second cross machine direction extending surface 49 to form a scraping edge 50.

To start a new winding core 26 in the winder 20, the winder is brought to a stop, and a completed roll set (not shown) is removed from the winder 20. The pulp web 32 is cut to form a tail 62, as shown in FIG. 1. The new winding core 26 is then positioned between the two winding drums 22, 24. The winding core 26 has a cylindrical surface 52, shown in FIG. 2, on which a strip of double-sided sticky tape 54 has been adhered. The scraping edge 50 of the scraping and pressing device 36 is then moved along the cylindrical surface 33 of the rear winder drum 22, as shown in FIG. 2, to scrape the pulp web 32 away from the rear winder drum cylindrical surface 33 so that it travels upwardly along the concave surface 48 of the scraping structure 42. After the scraping and pressing device 36 is brought into engagement with the rear winder drum cylindrical surface 33 it is moved circumferentially about the rear drum 22. The continued motion of the beam 40 and the scraping structure 42 causes the concave surface 48 of the scraping structure 42 to engage the surface 52 of the winding core 26, pressing the pulp web 32 against the double-sided sticky tape 54 on the core surface 52 to attach the pulp web 32 to the winding core 26. Thus the entire process of starting a new set in the winder 20 of a web 32 such as a roll pulp web, may be automated, thus improving productivity and worker safety.

It should be understood that various mechanical arrangements could be used to control the motion of the scraping and pressing device 36 so as to separate the web tail 62 from the winder drum surface 33 and to press the tail on to a winding core.

It should be understood that the pressing devices 36 are particularly useful for transferring a relatively thick web such as board, liner board, and roll pulp onto a winding core. Ordinary paper webs are generally less than 0.010 inches thick whereas board, liner board, and roll pulp are thicker, generally greater than about 0.020 inches thick, and typically 0.040 to 0.060 inches thick for a roll pulp web. It should also be noted that the thick web may not lie on the surface 33, but, because of the web's inherent stiffness, may be separated from the surface 33 after the nip 30. Thus the scraping action of the scraping and pressing device 36 may constitute no more than the interposing of portions of the scraping and pressing device (i.e. the scraping structure 42, between the web tail 62 and the drum surface 33.

It is understood that the invention is not limited to the particular construction and arrangement of parts herein illustrated and described, but embraces all such modified forms thereof as come within the scope of the following claims.

We claim:

1. An apparatus for attaching a fiber web tail to a winding core, the apparatus comprising:

a winder drum having a cylindrical surface and an axis of rotation, wherein the direction in which the axis extends defines a cross machine direction;

a winding core having a cylindrical surface of a selected length and a selected winding core radius, the winding core radius defining a winding core curvature, wherein the winding core is positioned so that the winding core cylindrical surface forms a first cross machine direction extending nip with the cylindrical surface of the winder drum;

a cross machine direction extending scraping and pressing structure, the structure having portions forming a concave cross-machine-direction-extending surface thereon, the concave surface opening toward the winding core, and having a substantially similar curvature as the curvature of the winding core;

a cross-machine-direction-extending scraping edge forming part of the scraping and pressing structure; and wherein the scraping and pressing structure is mounted for movement with respect to the winder drum, so that the scraping edge moves along the cylindrical surface of the winder drum, towards the winding core, to bring the concave surface into engagement with the cylindrical surface of the winding core.

2. The apparatus of claim 1 further comprising a second winder drum having a second cylindrical surface, the second winder drum mounted for rotation and positioned to engage the winding core to form a second cross machine direction extending nip with the cylindrical surface of the winding core.

3. The apparatus of claim 1 wherein the concave surface extends substantially to the selected length of the winding core.

4. The apparatus of claim 1 further comprising a double-sided sticky tape mounted on the winding core cylindrical surface.

5. The apparatus of claim 1 wherein the scraping and pressing structure portions which form the concave surface also form the scraping edge.

6. The apparatus of claim 5 wherein the structure portions which form the concave surface and the scraping edge are comprised of a plurality of cross machine direction extending sections of ultrahigh molecular weight plastic.

7. The apparatus of claim 6 wherein the plastic sections are mounted to the scraping and pressing structure by elastic pads.

8. The apparatus of claim 5 wherein the scraping and pressing structure is mounted for motion along the surface of the winder drum, so that the scraping edge moves along the cylindrical surface of the winder drum, toward the winding core, and the concave surface comes into engagement with the cylindrical surface of the winding core.

9. A method for starting a reel about a winding core in a twin drum winder comprising the steps of:

moving a cross machine direction extending concave surface closely matched to a curvature defined by the winding core, from a position above the twin drum winder to a position between a fibrous web start, and a cylindrical surface of a rear winding drum of the twin drum winder;

moving the cross machine direction extending concave surface with respect to the cylindrical surface of a rear winding drum, so that a scraping edge of the cross machine direction extending concave surface, moves along the cylindrical surface of the rear winding drum, toward the winding core, and bring the concave surface into engagement with the cylindrical surface of the winding core so as to push the fibrous web start against the winding core positioned between the rear winding drum and a front winding drum of the twin drum winder; and mechanically pressing with the cross machine direction extending concave surface the web start against a sticky portion of the winding core to bond the web start to the winding core.

10. The method of claim 9 wherein the step of moving the concave surface so as to push the fibrous web start against the winding core includes the step of pushing a web start which has a thickness greater than about 0.020 inches against the winding core.

11. The method of claim 9 wherein the step of moving the concave surface so as to push the fibrous web start against the winding core includes the step of pushing a web start which has a thickness of 0.040 to 0.06 inches.

* * * * *